US010290255B2

(12) United States Patent
Wu et al.

(10) Patent No.: US 10,290,255 B2
(45) Date of Patent: May 14, 2019

(54) DATA DRIVER OF A MICROLED DISPLAY

(71) Applicant: Prilit Optronics, Inc., Tainan (TW)

(72) Inventors: Biing-Seng Wu, Tainan (TW); Fa-Ming Chen, Tainan (TW)

(73) Assignee: Prilit Optronics, Inc., Tainan (TW)

( * ) Notice: Subject to any disclaimer, the term of this patent is extended or adjusted under 35 U.S.C. 154(b) by 0 days.

(21) Appl. No.: 15/709,310

(22) Filed: Sep. 19, 2017

(65) Prior Publication Data

US 2018/0122286 A1 May 3, 2018

(30) Foreign Application Priority Data

Oct. 28, 2016 (TW) ..... 105135144 A
Jun. 6, 2017 (TW) ..... 106118734 A

(51) Int. Cl.
*G09G 3/20* (2006.01)
*G09G 3/32* (2016.01)

(52) U.S. Cl.
CPC ..... *G09G 3/2018* (2013.01); *G09G 3/2003* (2013.01); *G09G 3/32* (2013.01); *G09G 2310/08* (2013.01); *G09G 2320/02* (2013.01)

(58) Field of Classification Search
None
See application file for complete search history.

(56) References Cited

U.S. PATENT DOCUMENTS

2006/0164366 A1* 7/2006 Yu ..... G09G 3/3648 345/98
2009/0085845 A1* 4/2009 Cho ..... G09G 3/2014 345/83
2012/0313985 A1* 12/2012 Gotoh ..... G09G 3/3413 345/691

* cited by examiner

*Primary Examiner* — Christopher J Kohlman
(74) *Attorney, Agent, or Firm* — Donald E. Stout; Stout, Uxa & Buyan, LLP

(57) ABSTRACT

A data driver of a microLED display includes clock generators that generate pulse width modulation (PWM) clocks of corresponding primary colors respectively; counters that receive the PWM clocks of corresponding primary colors respectively and accordingly generate corresponding PWM signals; and comparators associated with corresponding data channels respectively for comparing a held data signal with the corresponding PWM signal, thereby generating a comparison result signal. In one embodiment, the data driver further includes switches configured to electrically short output nodes of channel amplifiers of corresponding primary colors respectively for testing uniformity of microLEDs of one color.

15 Claims, 7 Drawing Sheets

DATA DRIVER OF A MICROLED DISPLAY

CROSS-REFERENCE TO RELATED APPLICATIONS

This application claims priority of Taiwan Application No. 105135144, filed on Oct. 28, 2016, and Taiwan Application No. 106118734, filed on Jun. 6, 2017, the entire contents of which are hereby incorporated by reference.

BACKGROUND OF THE INVENTION

1. Field of the Invention

The present invention generally relates to a data driver, and more particularly to a data driver of a microLED display.

2. Description of Related Art

A micro light-emitting diode (microLED, mLED or μLED) display panel is one of flat panel displays, and is composed of microscopic microLEDs of a size of 1-10 micrometers. Compared to conventional liquid crystal display panels, the microLED display panels offer better contrast, response times and energy efficiency. Although both organic light-emitting diodes (OLEDs) and microLEDs possess good energy efficiency, the microLEDs, based on group III/V (e.g., GaN) LED technology, offer higher brightness, higher luminous efficacy and longer lifespan than the OLEDs.

White balance of a microLED display cannot be achieved easily due to different characteristics among microLEDs of different colors and different responses to colors by human eyes. Current adjust mechanism may be used to arrive at white balance at the cost of complex drivers.

Eight bits of display data in the microLED display allow 256 possible gray levels. More bits (e.g., ten bits) of data are ordinarily used to facilitate gamma correction. In an extreme case, however, display signal of value 1 has a width that is too narrow to drive the microLED.

Therefore, a need has thus arisen to propose a novel microLED display to overcome drawbacks of the conventional microLED display.

SUMMARY OF THE INVENTION

In view of the foregoing, it is an object of the embodiment of the present invention to provide a data driver of a microLED display to effectively achieve white balance without being affected by display data. Accordingly, microLEDs of the microLED display can be sufficiently driven.

According to one embodiment, a data driver of a microLED display includes clock generators, counters and comparators. The clock generators generate pulse width modulation (PWM) clocks of corresponding primary colors respectively. The counters receive the PWM clocks of corresponding primary colors respectively and accordingly generate corresponding PWM signals. The comparators associated with corresponding data channels respectively compare a held data signal with the corresponding PWM signal, thereby generating a comparison result signal. In one embodiment, the data driver further includes switches configured to electrically short output nodes of channel amplifiers of corresponding primary colors respectively for testing uniformity of microLEDs of one color.

DETAILED DESCRIPTION OF THE INVENTION

Figure 1:
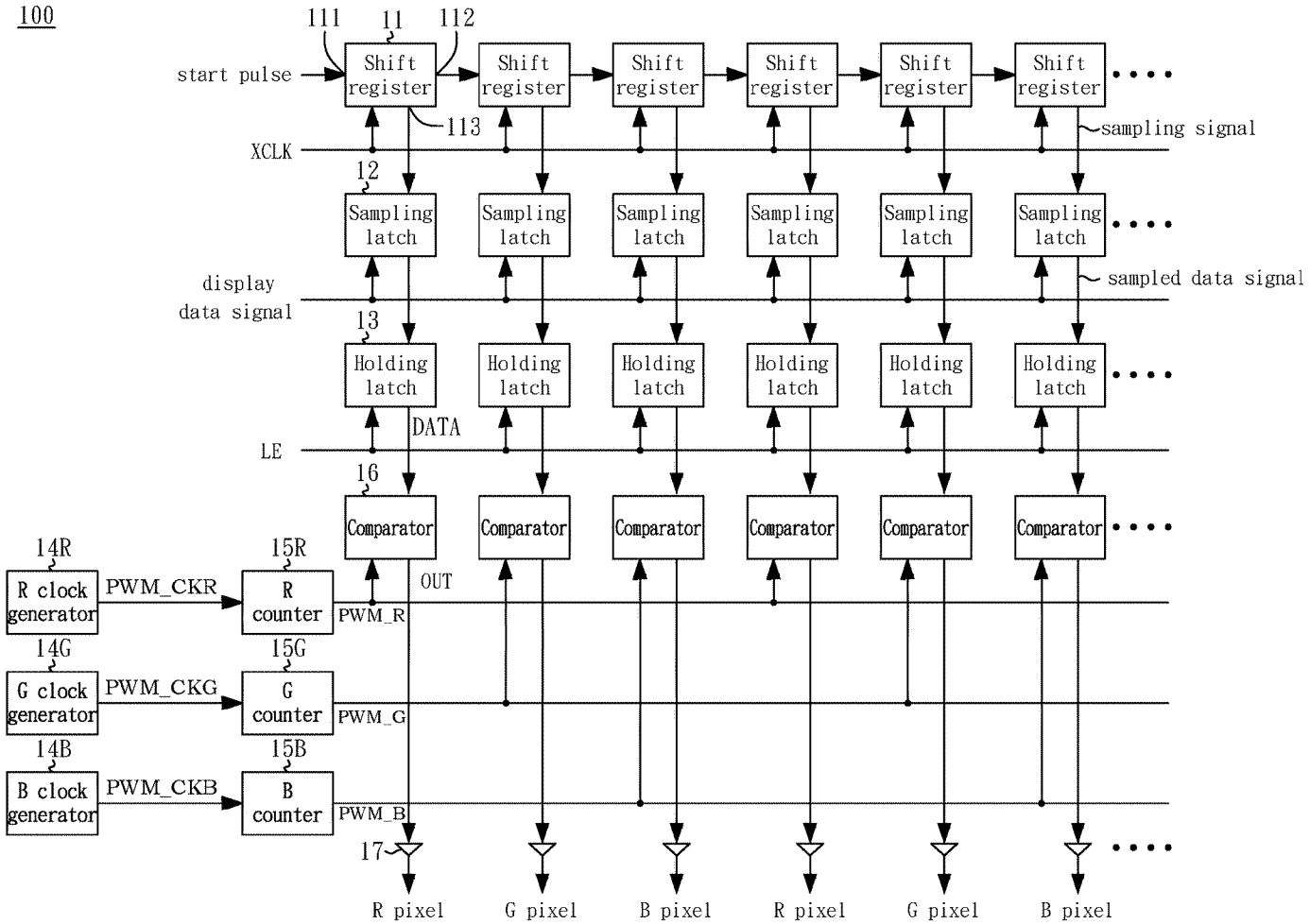
FIG. 1 shows a system block diagram illustrated of a data driver of a microLED display according to a first embodiment of the present invention.

FIG. 1 shows a system block diagram illustrated of a data driver 100 of a microLED display according to a first embodiment of the present invention. The data channels as exemplified in, but not limited to, FIG. 1 are red pixel channel, green pixel channel and blue pixel channel in sequence.

In the embodiment, each data channel of the data driver 100 may include a shift register 11 configured to generate a sampling signal. As shown in FIG. 1, the shift registers 11 of all data channels are connected in series and are controlled by a system clock XCLK. The first (e.g., the leftmost) shift register 11 has a serial input node 111 receiving a start pulse, and the other shift registers 11 each has a serial input node 111 receiving an output of a serial output node 112 of a preceding shift register 11. A parallel output node 113 of each shift register 11 outputs the sampling signal. Accordingly, the start pulse shifts from the first (e.g., the leftmost) toward the final (e.g., the rightest) shift register 11 in a manner that the shift registers 11 of a row generate corresponding sampling signals in sequence.

Each data channel of the data driver 100 may include a sampling latch 12 configured to latch a display data signal according to the sampling signal, thereby outputting a sampled data signal. Each data channel of the data driver 100 may include a holding latch 13, controlled by a latch signal LE, configured to hold the sampled data signal, thereby outputting a held data signal DATA. In the embodiment, the display data signal is represented with 10 bits, which are composed of 8 bits for data gray levels and 2 bits for gamma correction. Therefore, the held data signal DATA has data bits being equal to data bits of the display data signal (or the sampled data signal).

According to one aspect of the embodiment, the data drier 100 may include a plurality of clock generators configured to generate pulse width modulation (PWM) clocks of corresponding primary colors respectively, where frequencies of the PWM clocks are different in general. In the embodiment, the primary colors may include red, green and blue. That is, the clock generators may include a red (R) clock generator 14R, a green (G) clock generator 14G and a blue (B) clock generator 14B, which generate a red PWM clock PWM_CKR, a green PWM clock PWM_CKG and a blue PWM clock PWM_CKB, respectively.

The data driver 100 may include a plurality of counters coupled to receive the PWM clocks of corresponding primary colors respectively, thereby generating corresponding PWM signals. In the embodiment, the primary colors may include red, green and blue. That is, the counters may include a red counter 15R, a green counter 15G and a blue counter 15B, which receive the red PWM clock PWM_CKR, the green PWM clock PWM_CKG and the blue PWM clock PWM_CKB respectively, thereby generating a red PWM signal PWM_R, a green PWM signal PWM_G and a blue PWM signal PWM_B.

Figure 2:
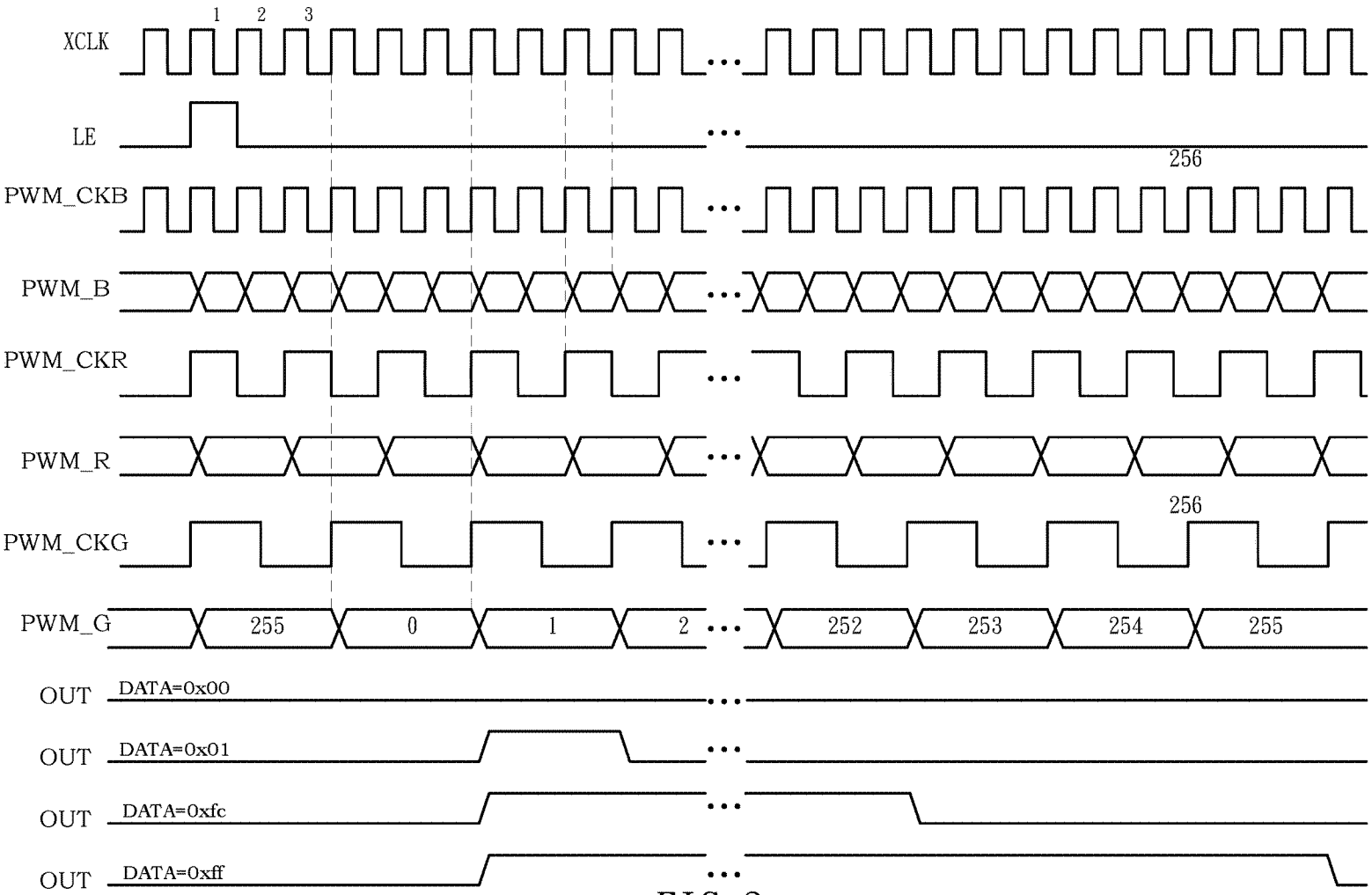
FIG. 2 shows exemplary timing diagrams of pertinent signals of FIG. 1.

Each data channel of the data driver 100 may include a comparator 16 configured to compare the held data signal DATA with the PWM signal of corresponding primary color (e.g., PWM_R, PWM_G and PWM_B), thereby generating a comparison result signal OUT. When the held data signal is greater than the PWM signal, the comparison result signal becomes logic high; otherwise the comparison result signal becomes logic low. FIG. 2 shows exemplary timing diagrams of pertinent signals of FIG. 1.

Figure 3A:
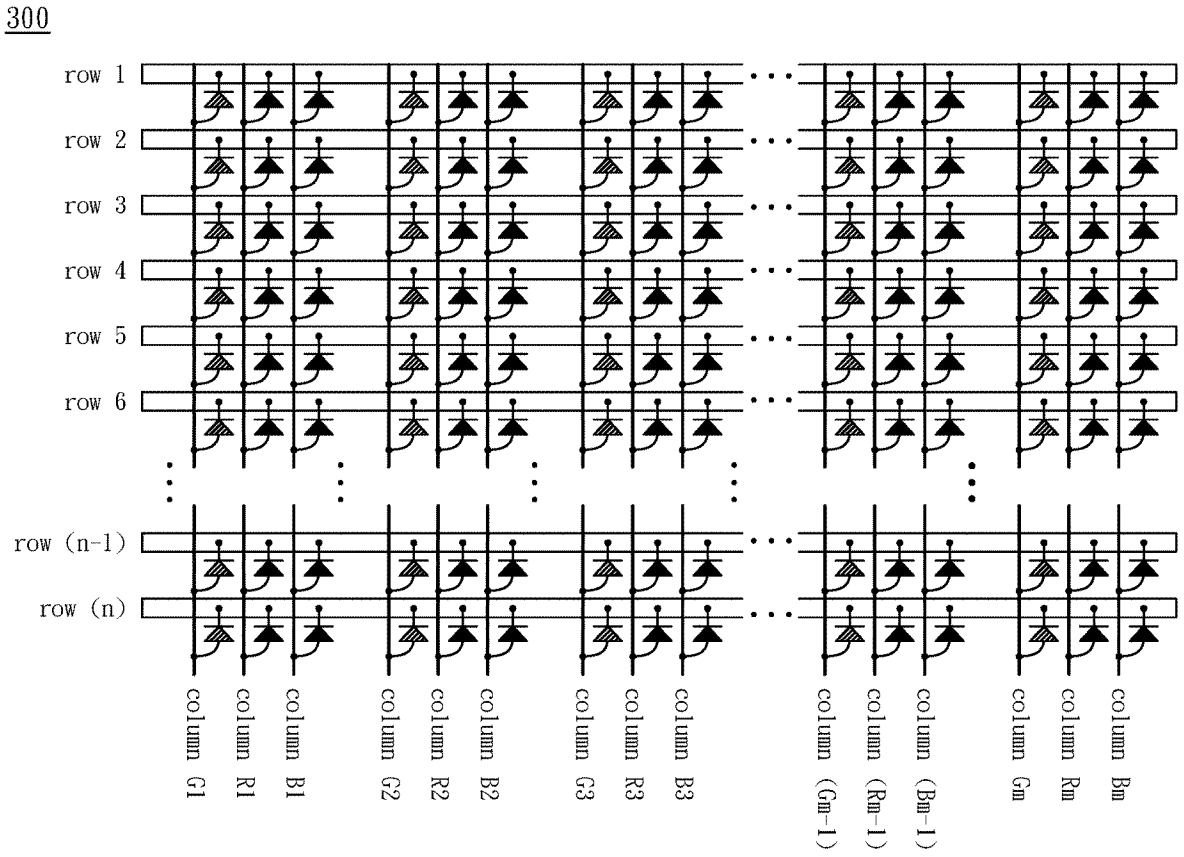
FIG. 3A shows a schematic diagram illustrated of a microLED display panel.
Figure 3B:
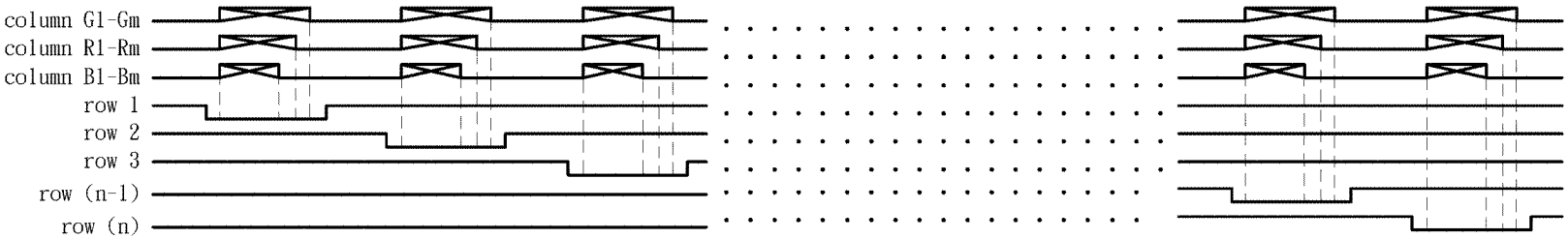
FIG. 3B shows exemplary row driving signals and column driving signals of FIG. 3A.

Each data channel of the data driver 100 may include a channel amplifier 17 (e.g., an operational amplifier) coupled to receive the comparison result signal OUT of the comparator 16, thereby generating an amplified signal for driving a microLED display panel. FIG. 3A shows a schematic diagram illustrated of a microLED display panel 300, which may include a plurality of microLEDs arranged in a matrix pattern. Anodes of the microLEDs on a column are connected together, and cathodes on a row are connected together. FIG. 3B shows exemplary row driving signals and column driving signals of FIG. 3A. The microLED turns on when the column driving signal is logic high and the row driving signal is logic low; otherwise the microLED turns off.

In the embodiment, the channel amplifier 17 outputs a fixed current. The channel amplifiers 17 of the same primary color have the same output currents, while the channel amplifiers 17 of different primary colors may have different output currents. For the reasons that microLEDs of different colors have different characteristics and human eyes respond to colors differently, in an exemplary embodiment, a ratio of output currents of channel amplifiers 17 of red to green to blue may be 2:3:1.

According to the embodiment proposed above, the frequencies of the PWM signals (e.g., PWM_R, PWM_G and PWM_B) are controlled by PWM clocks (e.g., PWM_CKR, PWM_CKG and PWM_CKB) of corresponding primary colors. Therefore, the pulse widths of the comparison result signals of primary colors can be fine adjusted to achieve white balance.

Figure 4:
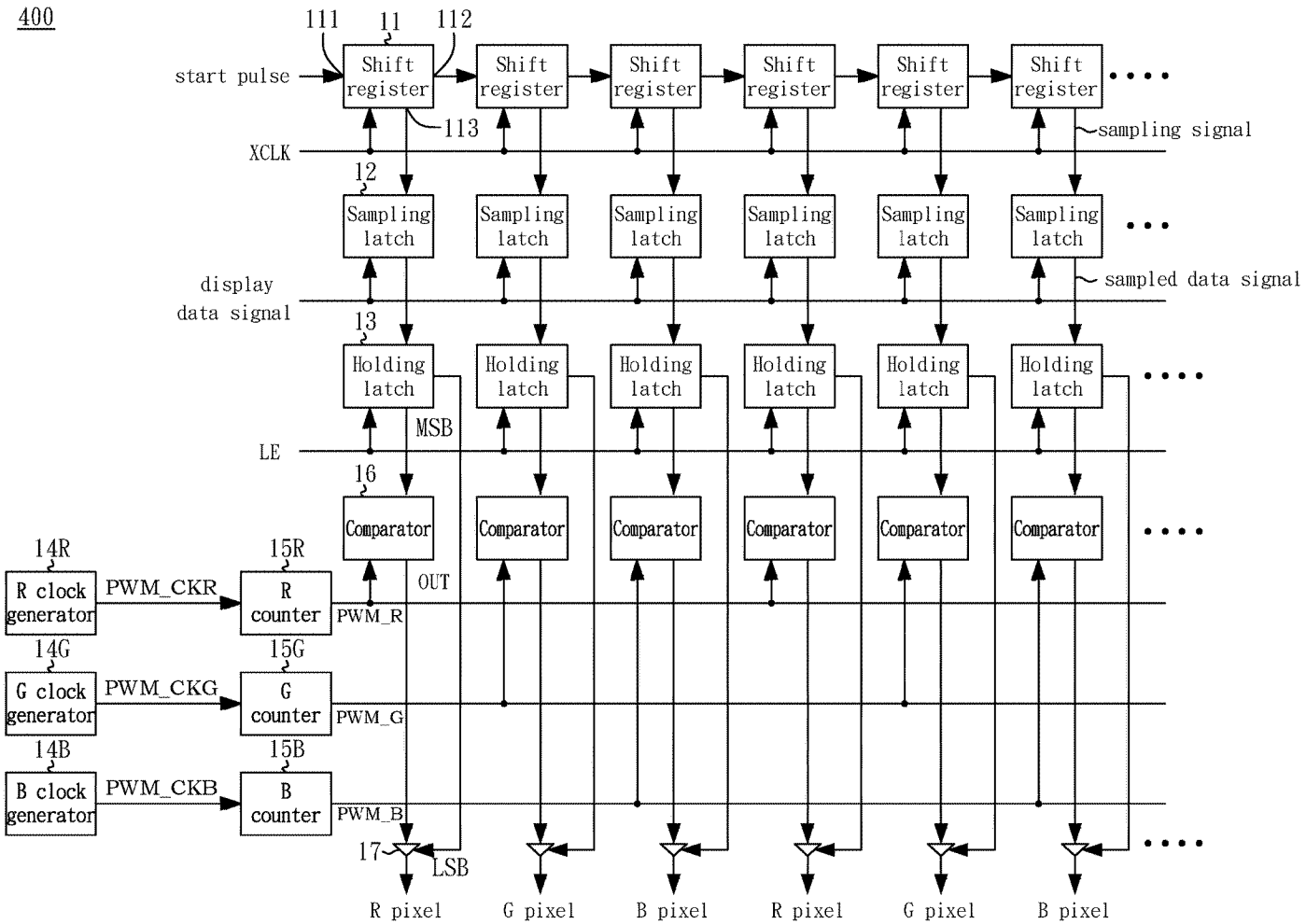
FIG. 4 shows a system block diagram illustrated of a data driver of a microLED display according to a second embodiment of the present invention.

FIG. 4 shows a system block diagram illustrated of a data driver 400 of a microLED display according to a second embodiment of the present invention. The present embodiment is similar to the first embodiment (FIG. 1), and details of the same are omitted for brevity.

Each data channel of the data driver 400 may include a shift register 11 configured to generate a sampling signal. Each data channel may include a sampling latch 12 configured to latch a display data signal according to the sampling signal, thereby outputting a sampled data signal. Each data channel may include a holding latch 13, controlled by a latch signal LE, configured to hold the sampled data signal, thereby outputting a held data signal DATA. The data driver 400 may include a plurality of clock generators (e.g., a red clock generator 14R, a green clock generator 14G and a blue clock generator 14B) configured to generate pulse width modulation (PWM) clocks (e.g., a red PWM clock PWM_CKR, a green PWM clock PWM_CKG and a blue PWM clock PWM_CKB) of corresponding primary colors respectively, where frequencies of the PWM clocks are different in general. The data driver 400 may include a plurality of counters (e.g., a red counter 15R, a green counter 15G and a blue counter 15B) coupled to receive the PWM clocks of corresponding primary colors respectively, thereby generating corresponding PWM signals (e.g., a red PWM signal PWM_R, a green PWM signal PWM_G and a blue PWM signal PWM_B).

Each data channel of the data driver 400 may include a comparator 16 configured to compare the held data signal DATA with the PWM signal of corresponding primary color (e.g., PWM_R, PWM_G and PWM_B), thereby generating a comparison result signal OUT. Each data channel may include a channel amplifier 17 coupled to receive the comparison result signal OUT of the comparator 16, thereby generating an amplified signal for driving a microLED display panel 300.

In the embodiment, the display data signal is represented with 10 bits. When the display data signal has a value of, or near, 1, a corresponding width is too narrow to drive the microLEDs of the microLED display panel 300 (FIG. 3A). In the embodiment, nevertheless, the holding latch 13 outputs more significant bits (MSB) to the comparator 16, while at least one less significant bit (LSB) is fed to the channel amplifier 17. In the embodiment, each channel amplifier 17 may output different currents selectable by the less significant bit (LSB) of the held data signal DATA. The less value the LSB has, the smaller current the channel amplifier 17 outputs. In one example, 8 more significant bits (MSB) of the held data signal DATA are fed to the comparator 16, while 2 less significant bits (LSB) of the held data signal DATA are fed to the channel amplifier 17, which may output four different currents selectable by the LSB.

According to the second embodiment proposed above, as the comparator 16 receives MSB of the held data signal DATA, a corresponding pulse width will not be too small even the value of MSB is small. Therefore, the microLEDs of the microLED display panel 300 may be sufficiently driven.

Figure 5:
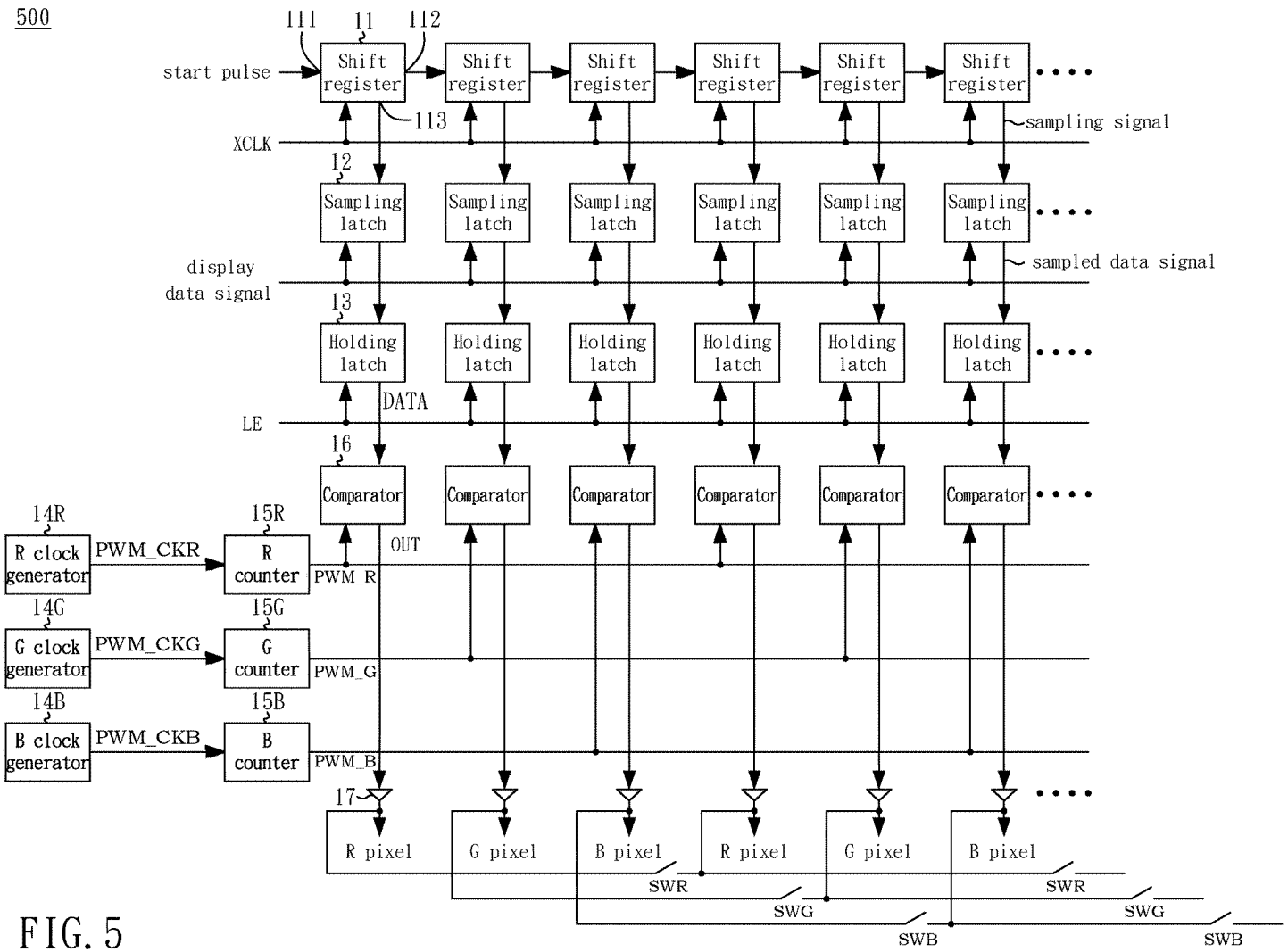
FIG. 5 shows a system block diagram illustrated of a data driver of a microLED display according to a third embodiment of the present invention.

FIG. 5 shows a system block diagram illustrated of a data driver 500 of a microLED display according to a third embodiment of the present invention. The present embodiment is similar to the data driver 100 (FIG. 1) of the first embodiment, and details of the same are omitted for brevity. According to one aspect of the embodiment, the data driver 500 may include a plurality of switches configured to electrically short output nodes of the channel amplifiers 17 of corresponding primary colors respectively. In the embodiment, the primary colors may include red, green and blue. That is, the switches may include red channel switches SWR, green channel switches SWG and blue channel switches SWB. In the embodiment, the red channel switches SWR are disposed between neighbor channel amplifiers 17 of red data channel, the green channel switches SWG are disposed between neighbor channel amplifiers 17 of green data channel, and the blue channel switches SWB are disposed between neighbor channel amplifiers 17 of blue data channel.

The switches SWR, SWG and SWB are normally open, but are closed in test mode to test uniformity of the microLEDs of the microLED display panel 300. Specifically, the red channel switches SWR are closed in testing red microLEDs, thereby electrically shorting output nodes of the channel amplifiers 17 of red data channel. As the output nodes of the channel amplifiers of red data channel have the same voltage while being electrically shorted, all the red microLEDs should have the same brightness provided that the red microLEDs have the same characteristics. If the characteristics of the red microLEDs are not the same, different levels of brightness occur. In this situation, the brightness of the microLEDs may be made the same by adjusting internal parameters of the data driver 500 (e.g., by adjusting output currents of the channel amplifiers 17). Uniformity test for green microLEDs and blue microLEDs may be performed in the same manner. Specifically, the green channel switches SWG are closed in testing green microLEDs, thereby electrically shorting output nodes of the channel amplifiers 17 of green data channel; and the blue channel switches SWB are closed in testing blue microLEDs, thereby electrically shorting output nodes of the channel amplifiers 17 of blue data channel.

Figure 6:
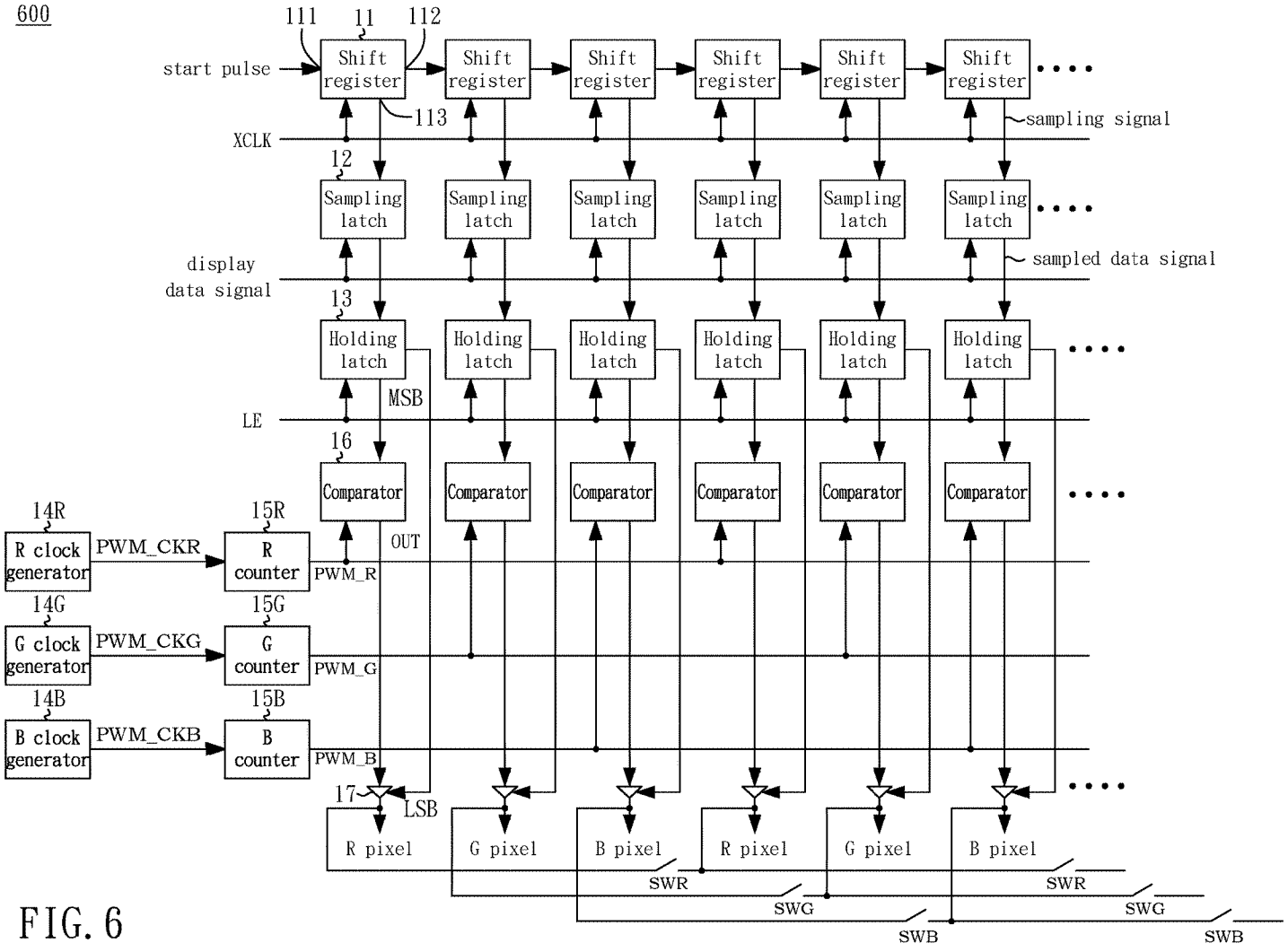
FIG. 6 shows a system block diagram illustrated of a data driver of a microLED display according to a fourth embodiment of the present invention.

FIG. 6 shows a system block diagram illustrated of a data driver 600 of a microLED display according to a fourth embodiment of the present invention. The present embodiment is similar to the data driver 400 (FIG. 4) of the second embodiment, and details of the same are omitted for brevity. According to one aspect of the embodiment, the data driver 600 may include a plurality of switches configured to electrically short output nodes of the channel amplifiers 17 of corresponding primary colors respectively. The configuration and operation of the switches as described in the third embodiment may be well applied in the present embodiment.

Although specific embodiments have been illustrated and described, it will be appreciated by those skilled in the art that various modifications may be made without departing from the scope of the present invention, which is intended to be limited solely by the appended claims.

What is claimed is:

1. A data driver of a microLED display, comprising:

a plurality of clock generators that generate pulse width modulation (PWM) clocks of corresponding primary colors respectively;

a plurality of counters that receive the PWM clocks of corresponding primary colors respectively and accordingly generate corresponding PWM signals;

a plurality of comparators associated with corresponding data channels respectively, each said comparator comparing a held data signal with the corresponding PWM signal, thereby generating a comparison result signal; and a plurality of channel amplifiers associated with data channels respectively, each said channel amplifier being coupled to receive the comparison result signal, thereby generating an amplified signal for driving a microLED display panel;

wherein frequencies of the PWM clocks are different;

wherein the held data signal and the display data signal have same data bits, and the channel amplifier outputs a fixed current.

2. The data driver of claim 1, wherein the primary colors comprise red, green and blue.

3. The data driver of claim 1, wherein the comparison result signal becomes logic high when the held data signal is greater than the PWM signal, otherwise the comparison result signal becomes logic low.

4. The data driver of claim 1, further comprising:

a plurality of shift registers associated with data channels respectively for generating sampling signals;

a plurality of sampling latches associated with data channels respectively, each said sampling latch latching a display data signal according to the sampling signal, thereby outputting a sampled data signal; and a plurality of holding latches associated with data channels respectively, each said holding latch holding the sampled data signal, thereby outputting a held data signal.

5. The data driver of claim 1, wherein the channel amplifiers of same primary color have same output currents, while the channel amplifiers of different primary colors have different output currents.

6. A data driver of a microLED display, comprising:

a plurality of clock generators that generate pulse width modulation (PWM) clocks of corresponding primary colors respectively;

a plurality of counters that receive the PWM clocks of corresponding primary colors respectively and accordingly generate corresponding PWM signals;

a plurality of comparators associated with corresponding data channels respectively, each said comparator comparing a held data signal with the corresponding PWM signal, thereby generating a comparison result signal;

a plurality of channel amplifiers associated with data channels respectively, each said channel amplifier being coupled to receive the comparison result signal, thereby generating an amplified signal for driving a microLED display panel; and a plurality of switches that electrically short output nodes of channel amplifiers of corresponding primary colors respectively.

7. The data driver of claim 6, wherein the switches comprise red channel switches, green channel switches and blue channel switches, the red channel switches being disposed between neighbor channel amplifiers of red data channel, the green channel switches being disposed between neighbor channel amplifiers of green data channel, and the blue channel switches being disposed between neighbor channel amplifiers of blue data channel.

8. The data driver of claim 6, wherein the switches associated with one primary color are closed to electrically short output nodes of the channel amplifiers associated with said primary color for testing uniformity of microLEDs of said primary color.

9. A data driver of a microLED display, comprising:

a plurality of clock generators that generate pulse width modulation (PWM) clocks of corresponding primary colors respectively;

a plurality of counters that receive the PWM clocks of corresponding primary colors respectively and accordingly generate corresponding PWM signals;

a plurality of comparators associated with corresponding data channels respectively, each said comparator comparing a held data signal with the corresponding PWM signal, thereby generating a comparison result signal; and a plurality of channel amplifiers associated with data channels respectively, each said channel amplifier being coupled to receive the comparison result signal, thereby generating an amplified signal for driving a microLED display panel;

wherein the held data signal has data bits less than the display data signal.

10. The data driver of claim 9, wherein each said channel amplifier outputs one of different currents selectable by less significant bit or bits (LSB) of the held data signal.

11. The data driver of claim 10, wherein less value the LSB of the held data signal has, smaller current the channel amplifier outputs.

12. The data driver of claim 9, wherein the comparator receives more significant bits (MSB) of the held data signal.

13. The data driver of claim 9, further comprising a plurality of switches that electrically short output nodes of channel amplifiers of corresponding primary colors respectively.

14. The data driver of claim 13, wherein the switches comprise red channel switches, green channel switches and blue channel switches, the red channel switches being disposed between neighbor channel amplifiers of red data channel, the green channel switches being disposed between neighbor channel amplifiers of green data channel, and the blue channel switches being disposed between neighbor channel amplifiers of blue data channel.

15. The data driver of claim 13, wherein the switches associated with one primary color are closed to electrically short output nodes of the channel amplifiers associated with said primary color for testing uniformity of microLEDs of said primary color.

* * * * *